US007175063B2

(12) United States Patent
Osuga et al.

(10) Patent No.: US 7,175,063 B2
(45) Date of Patent: Feb. 13, 2007

(54) POWERED NAILING MACHINE

(75) Inventors: Satoshi Osuga, Tokyo (JP); Hiroshi Tanaka, Tokyo (JP); Katsuhiko Murayama, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 10/563,260

(22) PCT Filed: Jun. 22, 2004

(86) PCT No.: PCT/JP2004/009070

§ 371 (c)(1),
(2), (4) Date: Jan. 4, 2006

(87) PCT Pub. No.: WO2005/002800

PCT Pub. Date: Jan. 13, 2005

(65) Prior Publication Data

US 2006/0157528 A1 Jul. 20, 2006

(30) Foreign Application Priority Data

Jul. 4, 2003 (JP) ..... 2003-270935

(51) Int. Cl.
*B25C 1/04* (2006.01)

(52) U.S. Cl. ..... 227/8; 227/130

(58) Field of Classification Search ..... 227/120, 227/130, 142, 8

See application file for complete search history.

(56) References Cited

U.S. PATENT DOCUMENTS 4,821,937 A * 4/1989 Rafferty ..... 227/8
5,263,842 A * 11/1993 Fealey ..... 227/8
5,649,661 A * 7/1997 Masuno et al. ..... 227/8
5,683,024 A * 11/1997 Eminger et al. ..... 227/8
5,715,982 A * 2/1998 Adachi ..... 227/8
5,785,227 A * 7/1998 Akiba ..... 227/8
6,138,887 A * 10/2000 Nayrac et al. ..... 227/8
6,695,192 B1 * 2/2004 Kwok ..... 227/8
6,883,696 B1 * 4/2005 Steinbrunner et al. ..... 227/8
6,892,922 B2 * 5/2005 Tucker et al. ..... 227/136
6,966,476 B2 * 11/2005 Jalbert et al. ..... 227/8

FOREIGN PATENT DOCUMENTS

| | | |
|---|---|---|
| JP | U-4-118984 | 10/1992 |
| JP | A-7-080782 | 3/1995 |
| JP | A-2000-000781 | 1/2000 |
| JP | A-2000-334676 | 12/2000 |
| JP | A-2001-162560 | 6/2001 |
| TW | 11-411897 | 9/1999 |

* cited by examiner

*Primary Examiner*—Scott A. Smith
(74) *Attorney, Agent, or Firm*—Morgan, Lewis & Bockius, LLP

(57) ABSTRACT

The guide rods 25, 26 extending straight along the discharge port 17 are fixed to the contact member 24, and this contact member 24 is retained slidably on the nose 16 via the guide rods 25, 26. The nose extension 23 is formed at the free end of the discharge port 17 so as to be integral with the nose 16 so that the nose extension covers the outer circumferential surface of the discharge port 17. The contact member 24 is held in the annular space formed between the nose extension 23 and discharge port 17, the contact member 24 being provided so as to project from free end of the nose extension.

7 Claims, 8 Drawing Sheets

POWERED NAILING MACHINE

TECHNICAL FIELD

The present invention relates to a combustion gas-driven nailing machine for striking a nail or a pin into a work, such as a concrete and a wooden material, by a driver connected to a piston by power-driving the piston by a pressure of a combustion gas generated by burning a combustible gas or by a pressure of compressed air; and a power driven nailing machine for striking the nail or the pin into the work by a driver connected to a piston by driving the piston in a cylinder by introducing compressed air into the cylinder holding the piston.

BACKGROUND ART

A combustion gas-driven nailing machine is known which is adapted to strike a nail into a steel plate or a concrete by a driver connected to a piston, by injecting a combustible gas into a closed combustion chamber and forming a mixed gas of the combustible gas and air in the combustion chamber, igniting the mixed gas and burning the same, imparting a high-pressure combustion gas thus generated in the combustion chamber to the piston slidably held in a cylinder and thereby driving the piston with an impact in the cylinder, and striking the driver. A compressed air driven nailing machine is also known in which compressed air is introduced into a cylinder holding a piston, a piston is driven in the cylinder, a nail is thereby struck by a driver connected to the piston.

In the power driven nailing machine driven by the combustion gas and compressed air, a nose with a discharge port for striking out a nail therefrom toward a work and guiding the same is attached to a lower portion of a housing holding the cylinder. A driver connected to the piston is held and guided in the discharge port. A magazine holding a plurality of nails therein is connected to a rear portion of the nose. A nail supplied from the magazine to the discharge port of the nose is struck by the driver into the work disposed at a free end of the nose. In the combustion gas-driven nailing machine, a container filled with a combustible gas and a battery for igniting the combustible gas are both fixed in the machine, so that the machine is formed as a portable tool. Thus, it is possible to strike a nail into a work without being restricted by a power supply source, such as an electric power supply source and a compressed air supply source.

In the power driven nailing machine driven by a combustion gas, an outer circumferential wall of the nose in which the discharge port is formed is provided with a contact member slidably supported along the discharge port. The contact member is connected at an upper end portion thereof to a movable sleeve for opening and closing an intermediate portion between the combustion chamber and an exhaust port via a contact arm. When the contact member is moved up, the combustion chamber is shut off from the exhaust port, and the movable sleeve is operated so as to seal the combustion chamber, and make preparations for enabling the combustible gas to be introduced into the combustion chamber. When the contact member and a trigger are operated with the discharge port of the machine pressed to the work, the machine is started. Therefore, the contact member constitutes a safety unit that acts so that the machine cannot be started unless the discharge port is pushed to the work so as to operate the contact member.

In such a power driven nailing machine, the contact member is provided on an outer circumferential surface of a nose, and a contact arm for connecting the contact member and movable sleeve is provided along the outer circumferential surface of the nose. Therefore, if the contact member and contact arm are made to contact the work and the like in such a case when the machine is carried, or if the machine is made to drop by mistake, the contact member and contact arm is deformed or broken in some cases. In addition, the contact member and contact arm may be inadvertently operated by the hand of an operator or by the work when the contact member and contact arm inadvertently engage therewith. Therefore, there is a possibility that an accident may occur.

In order to prevent the contact member and contact arm from engaging with the work as mentioned above, and, in order to protect the nose and contact member against a shock occurring when the machine drops and the machine interferes with the work, a nailing machine provided with a protective shield so as to enclose the nose has already been proposed (refer to JP-A-2000-000781). However, in the nailing machine of JP-A-2000-000781, the protective shield is formed so as to enclose the nose as a whole, so that the outer dimensions of the nose become large. This causes the nail driven portion of the work to become difficult to be seen, and a nail driving operation for a narrow portion of the work to become impossible. Therefore, the operation efficiency decreases. In addition, since the protective shield is formed so as to cover a front portion of the nose, it is necessary to remove the magazine attached to a rear side of the nose, in order to remove a nail, when the discharge port of the nose gets clogged with the nails. Therefore, the nail removing operation carried out when the discharge port gets clogged with nails takes much time.

Moreover, a machine having a discharge port formed cylindrically for driving and guiding the nail toward the work, supporting the discharge port slidably with respect to the nose so that a free end of the discharge port projects toward a free end of a nose, and connecting an upper end portion of this discharge port to a movable sleeve also has already been proposed (refer to JP-A-2001-162560). In the nailing machine of JP-A-2001-162560, the outer dimensions of the nose can be set small, and the visibility of the nail driven portion of a work is improved. However, since the discharge port as a whole is moved, an operation of a timing for supplying a nail from a magazine to the inside of the discharge port is complicated, so that the construction of parts also becomes complicated. Moreover, since a link member by which the movable sleeve and discharge port are connected together is formed on an outer surface of a housing and connected thereto at a front portion of the nose. Therefore, a work and the hand of the operator touch the outer surface of the link member to cause the nailing machine to be broken or erroneously operated.

DISCLOSURE OF THE INVENTION

The problem of the present invention is to provide a power driven nailing machine capable of preventing the nailing machine from being erroneously operated due to the contact of the contact member, which forms a starting unit, with the work or the operator's inadvertent operation of the machine, and capable of easily carrying out the removal of the nail which gets clogged in the discharge port.

To solve the problem, a power driven nailing machine according to the present invention is characterized in that a contact mechanism of the machine has a guide rod fixed to a contact member so as to be integral therewith, and extending straight along a discharge port of a nose, the guide rod being fixed to a nose so as to be integral therewith, and slidably supported on the nose with the contact member thereby slidably held on the nose a nose extension being formed on the nose so as to be integral therewith and so as to cover circumferential surface of the discharge port so that a space is formed between nose extension and the outer circumferential surface of the free end of the discharge port of the nose. In the space formed between the nose extension and discharge port, the contact member is held, and the free end of the contact member is provided so that the free end thereof projects forward from the free end of the nose extension.

The power driven nailing machine according to the present invention may be provided with a striking mechanism formed by a cylinder formed in a housing, a combustion chamber formed in an upper portion of the cylinder, and a piston driven in the cylinder by a combustion gas generated in the combustion chamber, a valve mechanism urged so as to communicate the combustion chamber and an exhaust port with each other during a normal condition being provided between the combustion chamber and exhaust port, straight guide rods joined to a contact member being operatively connected to the valve mechanism, the contact member being brought into contact with a work and operated, the valve being thereby operated to shut off the combustion chamber from the exhaust port.

The power driven nailing machine may be further provided with a nail storage magazine having a pusher joined to the nose and pressing connected nails into the discharge port, and one of the straight guide rods joined to the contact member is provided engageably with the pusher. In a position in which the nails in the magazine run out, the operation of the contact member may be stopped by engaging the end portion of the guide rod with the pusher.

Since the contact member is retained on the nose by supporting the straight guide rods, which are fixed to the contact member, on the nose so that the guide rods are slidable along the discharge port of the nose. Therefore, the guide rods do not project to the outer surface of the nose, and the guide rods do not contact the work and hands of an operator to cause the machine to be operated in error.

The contact member is provided at a free end portion of the discharge port, and the nose extension is formed on only the free end portion of the nose so as to cover this contact member. This enables the outer dimensions of the nose to be set small, the visibility of the driven portion of the work to be thereby improved, and the operation efficiency to be also improved. Moreover, since the contact member and the free end portion of the discharge port are enclosed with the cover member made integral with the nose, the contact member and free end portion of the discharge port can be protected against a shock occurring when the tool drops. Even when a sufficient strength is given to the nose, the weight thereof does not increase greatly, so that the weight of the nose can be reduced with the operation efficiency not spoiled.

The upper portion of this nailing machine except the free end portion of the nose is formed identically with that of a regular nailing machine. Therefore, it becomes possible to form an opening in a front portion of the nose, and provide a latch mechanism and the like for fixing a driver guide detachably to the nose so as to close this opening. This enables the nailing machine to be formed so that an operation for removing the nail when the inside of the discharge port is clogged therewith from the opening formed in the front portion of the nose can be carried out.

Figure 1:
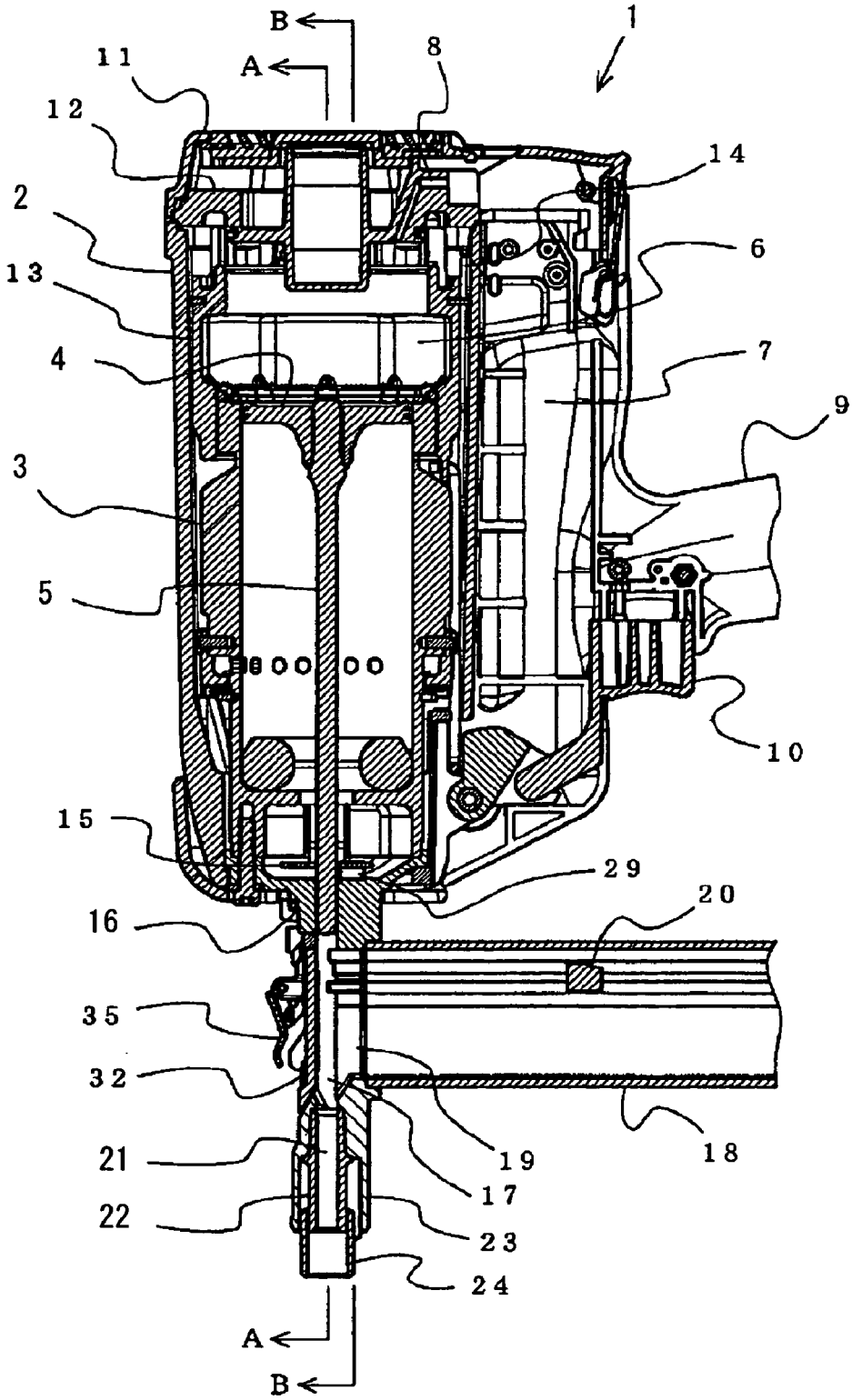
FIG. 1 is a longitudinally sectioned side elevation showing the power driven nailing machine according to the present invention.

Referring to the drawings, a reference numeral 1 denotes a combustion gas-driven nailing machine, 2 a housing, 5 a driver, 16 a nose, 17 a discharge port, 21 a free end of the discharge port, 22 a nose top, 23 a nose extension, 24 a contact member, 25 a guide rod, and 26 a guide rod.

BEST MODE FOR CARRYING OUT THE INVENTION

The present invention has achieved its object of preventing the contact member from touching the work or the fingers of an operator and the like of the operator to cause the nailing machine to be inadvertently operated, by rendering it possible not to spoil the visibility of the free end portion of the nose, and to carry out the nail removing operation easily when the nose gets clogged with nails.

The drawings show a combustion gas-driven nailing machine as an example of the power driven nailing machine showing an embodiment of the present invention. As shown in the longitudinally sectioned side elevation of FIG. 1, a combustion gas-driven nailing machine 1 has a cylinder 3 in a housing 2, and a piston 4 to a lower surface of which a driver 5 for striking a nail is joined is held slidably in this cylinder 3. At an upper end of the cylinder 3 on which an upper surface of the piston 5 is exposed, a combustion chamber 6 is formed. The piston 4 is driven in the cylinder 3 with a pressure of a combustion gas generated by burning a combustible gas in the combustion chamber 6. The combustible gas is stored in a container, such as a gas cylinder, and the container is fixed to a combustible gas holding portion 7, the combustible gas being supplied from the container to the interior of the combustion chamber 6 via a passage 8. The combustible gas is supplied to the interior of the combustion chamber 6 by operating a trigger 10 provided at a base portion of a grip 9 formed so as to be integral with the housing 2, and the combustible gas is mixed with the air in the combustion chamber 6. A gaseous mixture thus formed is ignited by an ignition unit and explosively burnt.

Figure 2:
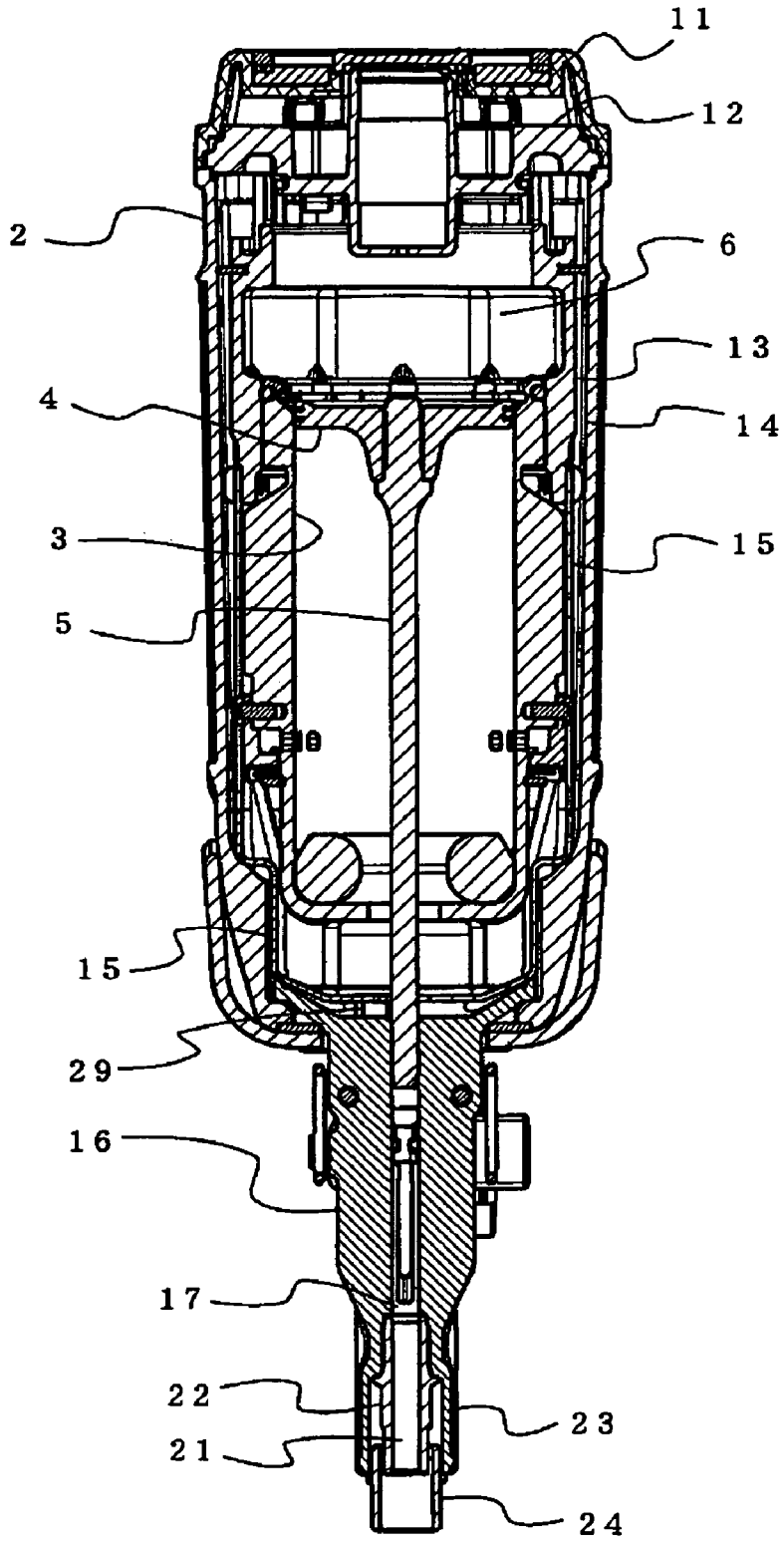
FIG. 2 is a sectional view taken along the line A—A in FIG. 1.

The combustion chamber 6 is defined by a partition 12 formed at an upper end portion of the cylinder 3 and a movable sleeve 13 formed annularly between the upper end of the cylinder 3 and partition 12. In order to discharge to the atmosphere the combustion gas in the combustion chamber 6 and cylinder 3 remaining after the nailing machine 1 is driven, the movable sleeve 13 forming an outer circumferential wall of the combustion chamber 6 is formed is formed slidably in the vertical direction. When the nailing machine 1 is not in operation in which the same machine 1 is not driven, the movable sleeve 13 is disposed in a lower position to communicate the combustion chamber with the atmosphere via an exhaust passage 14. As shown in FIG. 2, the lower end of the movable sleeve 13 is connected to a link member 15 as a valve mechanism provided in a space formed between the inner circumferential surface of the housing 2 and the outer circumferential surface of the cylinder 3. When the link member 15 is operated upward, the movable sleeve 13 is moved up, so that the combustion chamber 6 is shut off from the exhaust passage 14. The link member 15 is disposed at a lower portion thereof above a nose 16, which will be described later, in a position in a lower portion of the cylinder 3.

As shown in FIG. 1 and FIG. 2, a nose 16 having a discharge port 17 for guiding the striking of a nail toward a work is fixed to a lower portion of the housing 2, and the driver 5 joined to the piston 4 is guided slidably and held in the discharge port 17. A magazine 18 holding a plurality of nails therein is joined to a rear side portion of the nose 16, and the nails loaded in the magazine 18 are supplied to the inside of the discharge port 17 via an opening 19 formed at the rear side of the nose 16. The nails in the magazine 18 are set as connected nails in which the adjacent nails are joined together, and the nails are pressed from the rear end thereof by a pusher 20 urged by a spring toward the front side in the interior of the magazine 18. A front end nail is thus supplied to the interior of the discharge port 17.

A nose top 22 having a free end discharge port 21 formed so as to be aligned with the discharge port 17 formed in the nose 16 is fixed to the free end portion of the nose 16 by screwing so that only the free end portion of the discharge port which specially liable to be worn and damaged can be exchanged. At the free end of the nose 16, an annular nose extension 23 formed so that a free end thereof substantially becomes flush with that of the nose top 22 is provided so as to be integral with the nose 16. In an annular space formed between the inner circumferential surface of this nose extension 23 and the outer circumferential surface of the nose top 22, a contact member 24 is provided so as to project in the direction in which the free end of the nose top 22 extends downward so that the contact member 24 can engage with the work.

Figure 3:
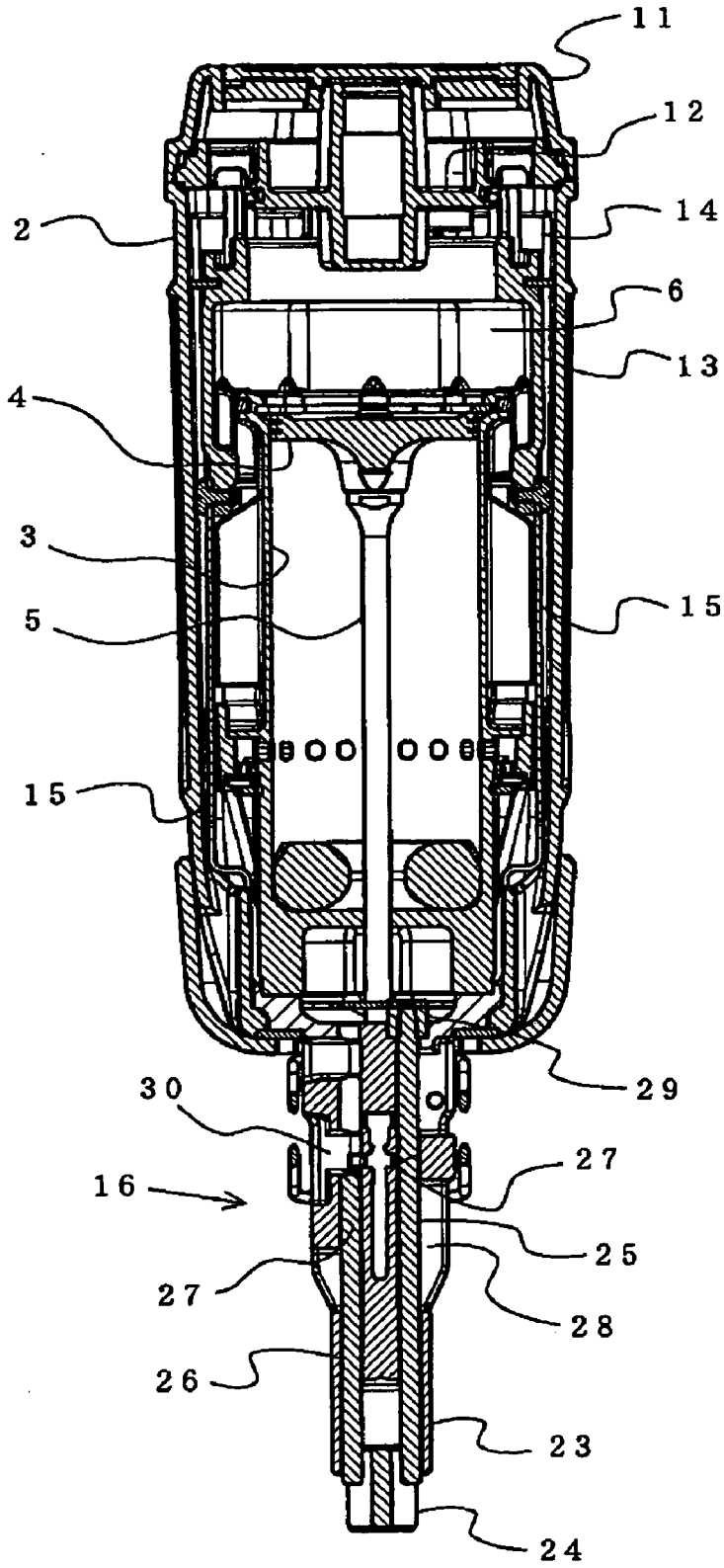
FIG. 3 is a sectional view taken along the line B—B in FIG. 1.
Figure 4:
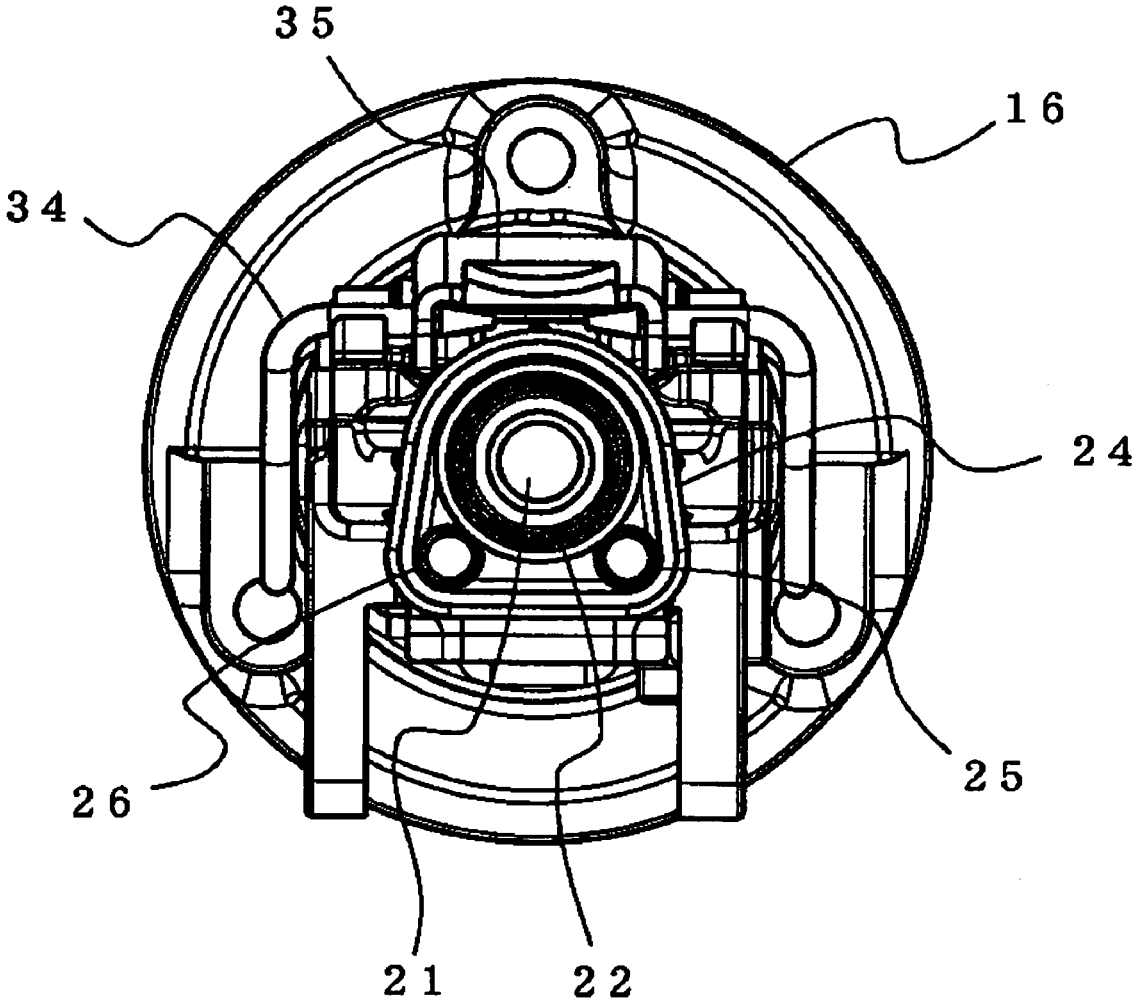
FIG. 4 is a bottom view of a nose of the power driven nailing machine identical with that shown in FIG. 1.
Figure 5:
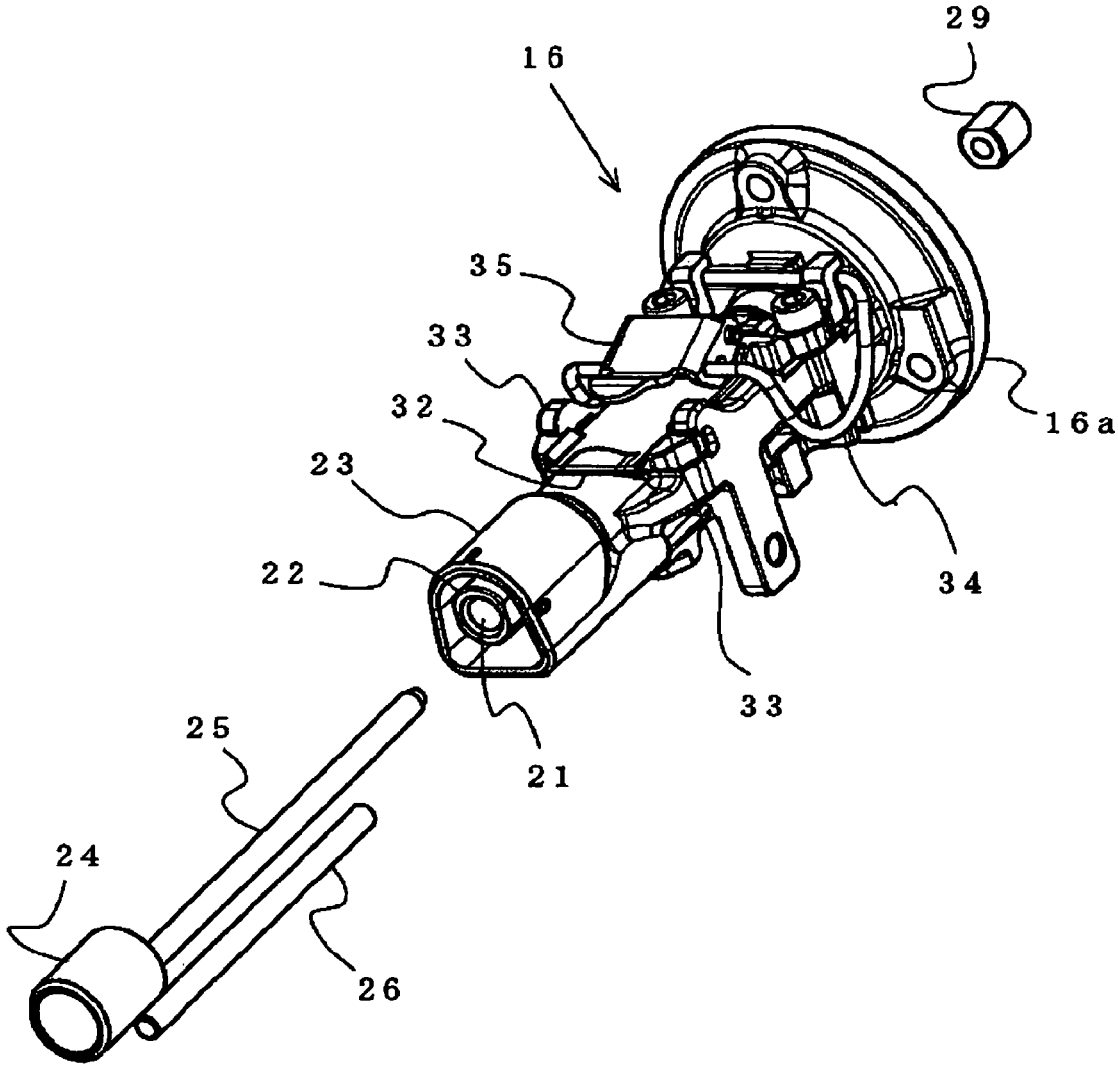
FIG. 5 is a perspective view of the nose of the power driven nailing machine identical with that in FIG. 1.

The contact member 24 is formed annularly as shown in FIG. 3 to FIG. 5, and held in the annular space formed between the nose extension 23 and nose top 22 so that the contact member 24 can be slidingly moved along the discharge port 17 of the nose 16. This contact member 24 has guide rods 25, 26 each of which is fixed at one end portion thereof to an outer circumferential surface of the contact member, and at the other end portion thereof extends straight. These rods 25, 26 support the contact member 24 so that the contact member 24 can be slidingly moved with respect to the nose 16. All of the guide rods 25, 26 are made of cross-sectionally circular rod members and extend straight as shown in FIG. 4 and FIG. 5. The first-mentioned end portion of each rod is fixed to the outer circumferential surface of the annular contact member 24 by welding and the like. The portions of the rods which extend straight in the upward direction are guided slidably along a guide hole 27 or a guide groove 28 formed in parallel with the discharge port 17 of the nose 16.

As shown in FIG. 3, the upper end portion of one guide rod 25 is formed on the upper surface side of the flange 16*a* through the flange 16*a* formed at the upper end portion of the nose 16, and an operating end 29 at the upper end of this guide rod 25 with which the lower end portion of the link member 15 is engaged as a valve mechanism is joined to the movable sleeve 13. A downward urging force is exerted on the link member 15 by a spring (not shown), and, owing to the urging force of this link member, the movable sleeve 13 is set in a position in which the interior of the combustion chamber 6 is communicated with the exhaust passage 14, and the free end portion of the contact member 24 is projected to a position further lower than those of the nose top 22 and nose extension 23. In order to start the nailing machine 1, the discharge port 17 is pressed against the work. As a result, the contact member 24 is operated as the contact member 24 engages with the work, so that the contact member 24 is moved up with the guide rod 25 along the discharge port 17 of the nose 16. When the operating end 29 is pressed, the operating end 29 of the guide rod 25, the operating end 29 is moved with the link member as the operating end engages with the link member 15. As a result, the movable sleeve 13 is moved up to shut off the interior of the combustion chamber 6 from the exhaust passage 14. Thus, the preparations for starting the nailing machine 1 are made.

Figure 6:
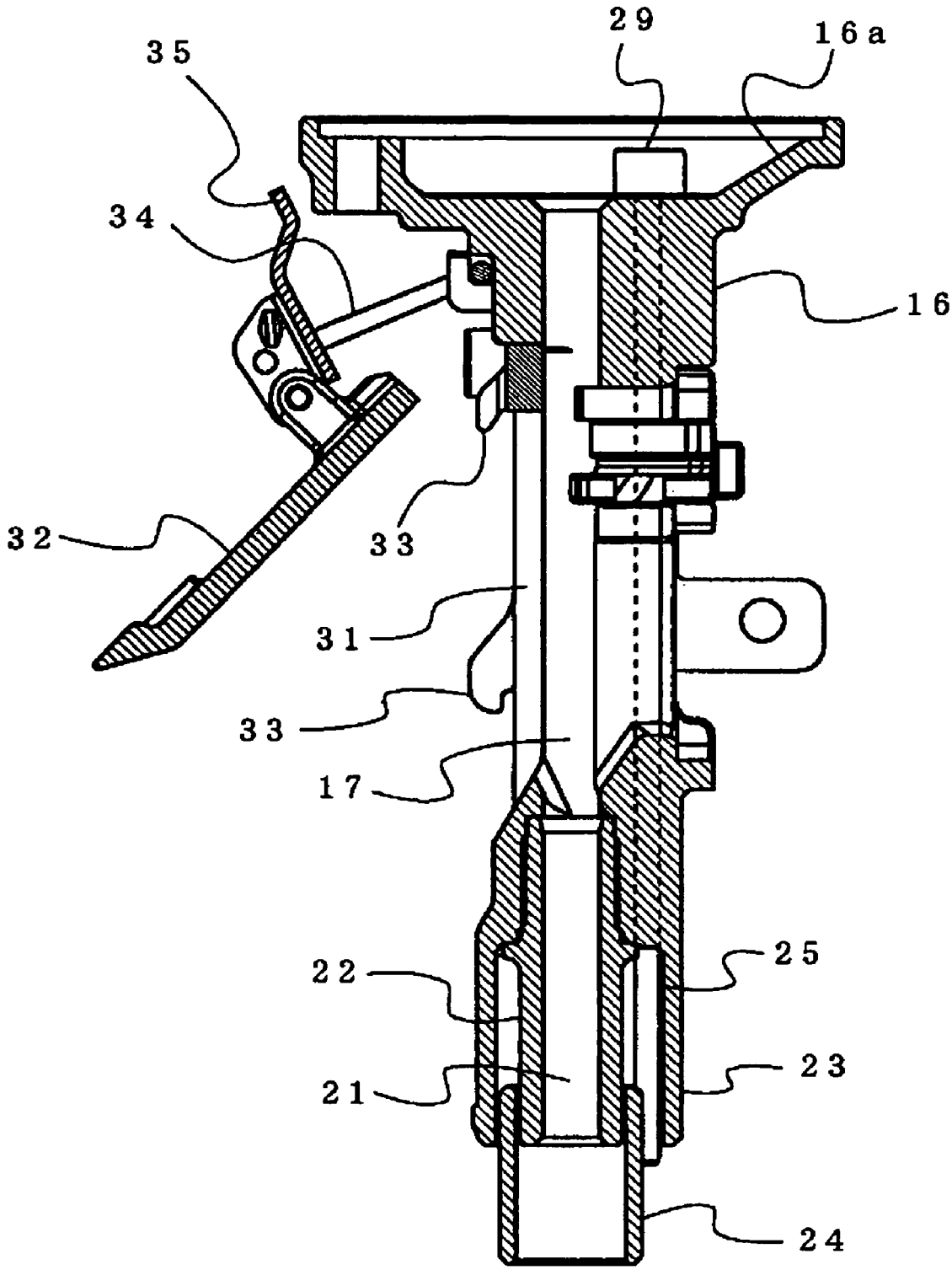
FIG. 6 is a sectional view of the nose the front portion of which is opened of the power driven nailing machine identical with that of FIG. 1.
Figure 7:
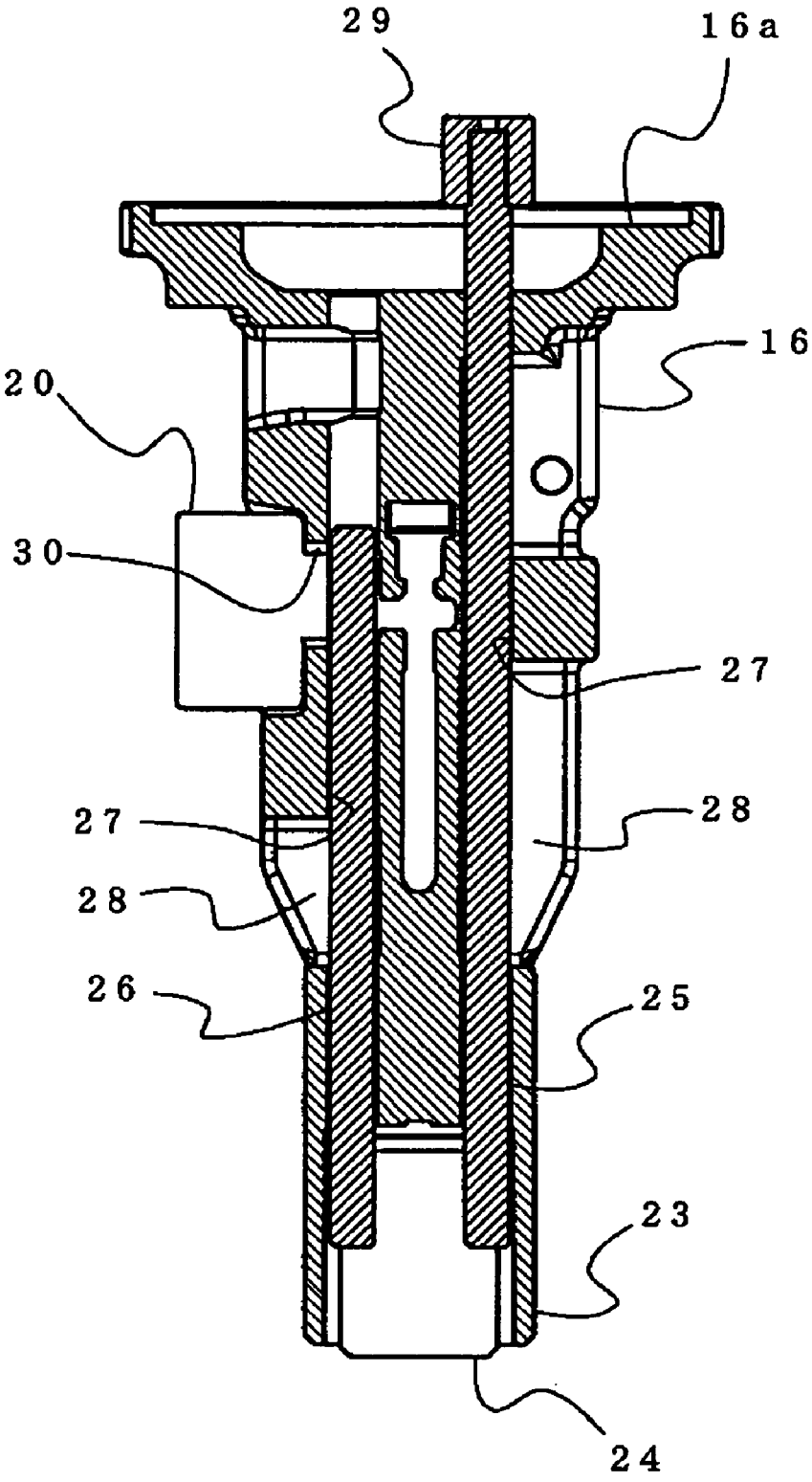
FIG. 7 is a longitudinally sectioned side elevation of the nose of the power driven nailing machine identical with that of FIG. 1, in which a contact member is in an operated condition.
Figure 8:
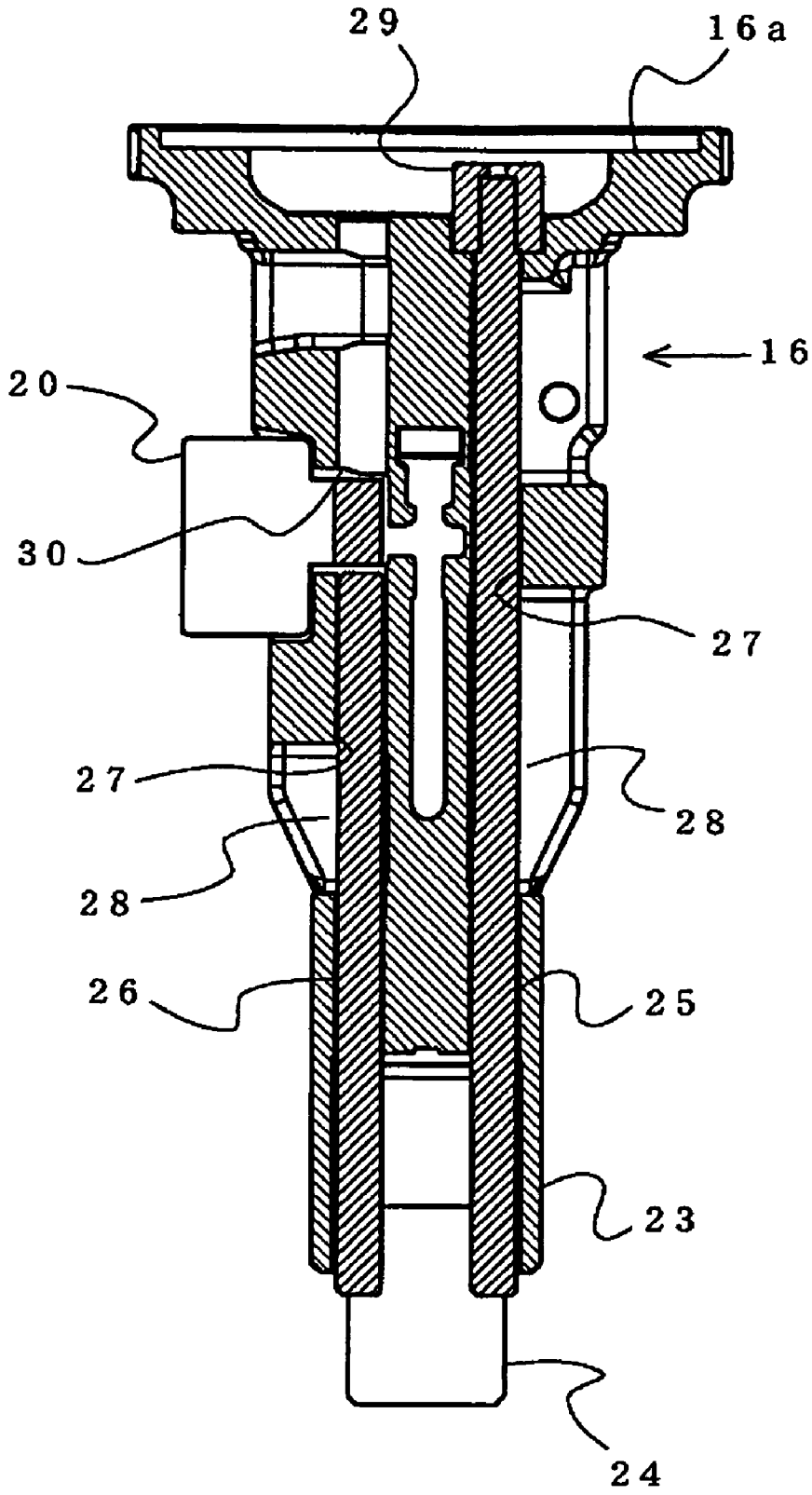
FIG. 8 is a sectional view of the nose of the power driven nailing machine identical with that of FIG. 1, in which nails do not exist in a magazine.

As shown in FIG. 7, the straight portion of the second-mentioned guide rod 26 fixed to the contact member 24 extends upward in parallel with the discharge port 17 of the nose 16, and the upper end of this guide rod is disposed so as to face a guide groove 30 in which the pusher 20 pressing the connected nails loaded in the magazine 18 is slidingly guided. When the pusher 20 is moved to a position in which a final nail in the magazine 18 is struck out so that the nails in the magazine run out, the upper end of the guide rod 26 engages with a part of the pusher 20, and an upward movement of the guide rod 26 is stopped as shown in FIG. 8. Owing to this structure, when the nails in the magazine 18 runs out, the upward movement of the contact member 24 is stopped, so that the closing of the combustion chamber 6 is not carried out. Therefore, the starting of the nailing machine is prevented. At the front side of the nose 16 forming the discharge port 17 is provided with an opening 31 as shown in FIG. 1 and FIG. 5 which is opened toward the front side of the nose 16, and a driver guide 32 is fixed detachably to the nose 16 so that the driver guide 32 covers the opening 31. The driver guide 32 is engaged at an upper end and lower portion thereof with a hook 33 formed on the nose 16, and fixed to the nose 16 with the elastic force of the latch spring 34. As shown in FIG. 6, the driver guide 32 can be removed from the opening 31 of the nose 16 by turning the latch lever 35. As a result, the discharge port 17 of the nose 16 is opened toward the front side of the nose 16, and the nails with which the discharge port 17 is clogged can be removed from the front portion of the nose 16.

In the description of the above embodiment, the combustion gas-driven nailing machine adapted to strike a nail into a work by driving the piston 4 with a pressure of a combustion gas generated in the combustion chamber 6 formed in the housing 2 was referred to. The present invention can also be practiced in, for example, a compressed air-driven nailing machine adapted to strike a nail into a work, such as a wooden material by a piston-connected driver by driving the piston by supplying combustion air into the cylinder. Such a compressed air-driven nailing machine is generally provided with a starting valve for introducing compressed air into a cylinder and starting the nailing machine, and a trigger lever formed on abase portion of a grip for operating the starting valve. An operating end 29 at an upper end of a guide rod 25 fixed to a contact member 24 may be disposed in the vicinity of the trigger lever so as to operate the starting valve by operating all of the trigger lever and contact member.

The present invention can also be practiced in an electrically driven nailing machine adapted to strike a nail into a work by actuating a driver by an electric actuator, such as an electric motor. Such an electrically driven nailing machine may be formed so that the electric actuator is driven by operating both an electric switch operated by actuating the trigger, and an electric switch operated by actuating a contact member.

According to the embodiments of the present invention described above, the contact member 24 is supported slidingly movably on the straight guide rods 25, 26 supported along the discharge port 17 of the nose 16. In the embodiment, the guide rods are formed to a circular cross-sectional shape. The guide rods 25, 26 may also be formed to a square cross-sectional shape. The guide rods 25, 26 can be formed by a minimum number of steps by using a commercially available cross-sectionally circular rod and cross-sectionally square rod, and the manufacturing cost can be reduced. When these guide rods 25, 26 are provided in the vicinity of the discharge port 17, it becomes possible to set the point of application and the point of force of loads of these rods can be set on a straight line, prevent the deformation and wear of the rods, improve the durability of the rods and operate the rods stably for a long period of time. The contact member 24 in the embodiment is formed annularly, and the space between the nose extension 23 and nose top 22 annularly as well. The contact member 24 may have, for example, a U-shaped cross-sectional shape and an angular U-shaped cross-sectional shape, and the space may be formed to a shape in conformity with that of the contact member 24. Moreover, the contact member 24 and guide rods may be made integral.

Since the guide rod 25 is supported slidingly movably in the guide hole 27 and guide groove formed in the nose 16, the engaging of the hands of the operator and work with the guide rod 25 can be prevented. Moreover, accidents, such as the engaging of the guide rod 25 with the work to cause the guide rod to be deformed, or the touching of the guide rod 25 with a finger of the operator to cause the guide rod to be inadvertently operated, and the tool to be operated can be prevented.

INDUSTRIAL APPLICABILITY

The embodiment of the present invention is provided with the nose having the discharge port slidably guiding the driver actuated by the striking mechanism driven by the power, such as a combustion gas pressure and a compressed air pressure, and the contact member supported slidably along the discharge port and projecting toward the free end of the discharge port, and the embodiment can be applied to a machine for striking a nail and a pin which is adapted to be driven by operating the contact member by bringing the contact member into contact with the work.

The invention claimed is:

1. A power driven nailing machine comprising:

a driver actuated by a striking mechanism held in a housing;

a nose connected to the housing and including a nose extension;

a discharge port for discharging a nail;

a contact member, disposed so as to project toward a free end of the discharge port along the discharge port, for engaging with a work so as to allow driving of the striking mechanism; and a guide rod fixed to the contact member, extending straight along the discharge port, and slidably supported on the nose so as to slidably hold the contact member on the nose, wherein a space is formed between an outer circumferential surface of the discharge port and an inner circumferential surface of the nose extension, and the contact member is held in the space, a free end of the contact member projects forward from a free end of the nose extension.

2. The power driven nailing machine according to claim 1, further comprising a nose top attached to a free end of the nose, wherein the discharge port comprises a discharge port of the nose, and a free end discharge port of the nose top.

3. The power driven nailing machine according to claim 2, wherein the space is formed between an outer circumferential surface of the nose top and an inner circumferential surface of the nose extension.

4. The power driven nailing machine according to claim 2, further comprising a guide formed in parallel with the discharge port of the nose, wherein the guide rod is slid along the guide.

5. The power driven nailing machine according to claim 1, further comprising:

a cylinder formed in the housing;

a combustion chamber formed in an upper portion of the cylinder;

a piston driven in the cylinder; and a valve mechanism provided between the combustion chamber and an exhaust port and urged so that the combustion chamber and the exhaust port communicate with each other, wherein the valve mechanism is operatively connected to the guide rods, and the valve is actuated, by bringing the contact member into contact with the work, so that the combustion chamber and an exhaust passage is shut off from each other.

6. The power driven nailing machine according to claim 1, further comprising:

a nail holding magazine connected to the nose and including a pusher for pressing the connected nails into the discharge port, wherein the guide rod is engageable with the pusher, and the contact member is prevented from being actuated by engaging an end portion of the guide rod with the pusher in a position of the pusher when the nails in the magazine run out.

7. The power driven nailing machine according to claim 6, wherein the guide rod includes a first and a second guide rods, the first guide rod is connected to the striking mechanism, the second guide rod is engageable with the pusher.

* * * * *